US007282683B2

(12) United States Patent
Yamauchi et al.

(10) Patent No.: US 7,282,683 B2
(45) Date of Patent: Oct. 16, 2007

(54) HIGH FREQUENCY HEATING APPARATUS

(75) Inventors: Masato Yamauchi, Souraku-gun (JP); Toshiyuki Ishiguro, Shiki-gun (JP); Hirofumi Yoshimura, Nara (JP); Fumihiko Migaki, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 209 days.

(21) Appl. No.: 11/105,717

(22) Filed: Apr. 14, 2005

(65) Prior Publication Data

US 2005/0178763 A1 Aug. 18, 2005

Related U.S. Application Data

(62) Division of application No. 10/307,815, filed on Dec. 2, 2002, now Pat. No. 6,894,260.

(30) Foreign Application Priority Data

Dec. 4, 2001 (JP) ..... 2001-369836
May 10, 2002 (JP) ..... 2002-135155

(51) Int. Cl.
*H05B 6/64* (2006.01)

(52) U.S. Cl. ..... 219/757; 219/756

(58) Field of Classification Search ..... 219/757, 219/756, 678, 758, 623, 632; 126/20, 19, 126/21; 361/381
See application file for complete search history.

(56) References Cited

U.S. PATENT DOCUMENTS 4,586,348 A 5/1986 Nakayama et al. ..... 62/277
4,880,952 A 11/1989 Hirai et al. ..... 219/685
5,534,681 A 7/1996 Hwang ..... 219/685
5,886,328 A 3/1999 Yun ..... 219/756
6,239,419 B1 5/2001 Kim
6,369,372 B1 4/2002 Kim ..... 219/756
6,512,214 B2 1/2003 Jeong et al. ..... 219/756
6,621,058 B1 * 9/2003 Kim ..... 219/757
6,653,610 B2 * 11/2003 Ahn ..... 219/756
6,657,171 B1 * 12/2003 Huynh et al. ..... 219/746
6,670,594 B1 * 12/2003 Jeong et al. ..... 219/757
6,707,019 B2 * 3/2004 Kim ..... 219/757
6,717,123 B1 * 4/2004 Kim ..... 219/757
6,723,970 B1 * 4/2004 Whipple, Jr. ..... 219/681
6,797,930 B2 * 9/2004 Kim ..... 219/757
6,812,444 B2 * 11/2004 Ahn ..... 219/757

FOREIGN PATENT DOCUMENTS

GB 2 329 467 3/1999

* cited by examiner

*Primary Examiner*—Daniel Robinson
(74) *Attorney, Agent, or Firm*—Pearne & Gordon LLP

(57) ABSTRACT

The present invention provides a high frequency heating apparatus having a structure, which can be mounted/dismounted an air-exhausting grille without any tools. In this apparatus, an air-exhausting grille is arranged by that a fixing claw portion having a bent Z-shape, a fixing hooking portion having a concave notch, and a magnetic joint plate are arranged, whereas a main body located opposite to the air-exhausting grille is arranged by that a slit hole, a hooking flange, and a magnetic fixing plate are arranged. As a result, since the magnetic joint plate is absorbed with the magnetic fixing plate to be fixed with each other, the mounting/dismounting work capability of the air-exhausting grille can be improved without using the tool in a simple manner, and furthermore, a clean cooking appliance can be secured, while the cooking appliance can be readily cleaned.

6 Claims, 9 Drawing Sheets

HIGH FREQUENCY HEATING APPARATUS

BACKGROUND OF THE INVENTION

1. Field of the Invention

The present invention is related to a mounting/dismounting structure of an air-exhausting grille of a hanging type, or wall-embedding type high frequency heating apparatus. The present invention is also related to a U-shaped body and a structure of an upper lid, which construct a housing of a hanging type microwave oven.

2. Description of the Related Art

Referring now to FIG. 1 and FIG. 6, a description will be made of the related art as to a structure of an air-exhausting grille of this sort of either a conventional hanging type or a conventional wall-embedding type high frequency heating apparatus.

In such a conventional hanging type high frequency heating apparatus as shown in FIG. 1, a plurality of gas, or electric burners 1 are provided at a lower portion of this heating apparatus and a high frequency heating apparatus 3 is hung so as to be set via a cooking space 2 at a center portion thereof. While a plurality of air-intake ports via a filter 4 are arranged at the lower portion of this high frequency heating apparatus 3, both a door 6 and a control panel 7 are arranged on a front surface of a main body thereof, and also, an air-exhausting grille 8 is mounted above these door 6 and control panel 7.

FIG. 6 shows a sectional structural view of the above-described air-exhausting grille when this grille is mounted. This air-exhausting grille is arranged in such a manner that a plurality of screw fixing holes 10 are formed in an upper surface guide 9 of the air-exhausting grille 8, and a plurality of claw portions 12 having bending flanges are formed on a lower surface guide 11. While a stepped portion is formed on a front edge of an upper mounting plate 13 of the main body in such a way that this stepped portion may absorb a thickness of the upper surface guide 9, a screw portion 14 is formed in the upper mounting plate 13 located at the same center axis as that of the screw fixing hole 10 of the upper surface guide 9 of the above-described air-exhausting grille 8 at this stepped portion. Also, a plurality of slit holes 16 into which the claw portions 12 are inserted are formed in a lower mounting plate 15 of the air-exhausting grille 8 at the same positions as those of the claw portions 12 of the lower surface guide 11.

Then, the claw portions 12 of the lower surface guide 11 of the above-described air-exhausting grille 8 is inserted into the slit holes 16, the screw fixing hole 10 of the upper surface guide 9 is fitted to the screw portion formed in the upper mounting plate 13, and then, the claw portions 12 are fastened by using a plurality of mounting screws 17 so as to be fixed.

In the related art shown in FIG. 9, a hanging type microwave oven is constituted by a floor-standing type microwave oven, an inverse U-shaped body, and a bottom plate. Reference numeral 101 shows the body having the inverse U-shape. The bottom plate 102 is overlapped with an edge plane 103 of the body 101 on the side of the bottom plane and is fastened to this edge plane 103 by using a screw. Reference numeral 104 shows a heating chamber of the microwave oven. This heating chamber 104 is provided with a ventilation-purpose fan 105 at an upper portion. The heating chamber owns air-exhaust paths (passages) 106 on both sides, and is equipped with a door 107 and an operation unit 108 at a front plane. An air-exhaust grille 109 is arranged at an upper portion of the front plane. Reference numeral 110 shows each of ventilation-purpose air-intake ports which are opened in right/left portions of the bottom plate 102. These ventilation-purpose air-intake ports are arranged by mounting thereon filters 111. Reference numeral 112 shows a cooking instrument installed on a lower portion of the hanging type microwave oven.

However, in the above-described conventional hanging type, or wall-embedding type high frequency heating apparatus, mixture gas is sucked by the air-exhausting fan mounted at the upper portion of this high frequency heating apparatus, and then is conducted via the filter from the air-intake port so as to be exhausted by the air-exhausting grille mounted at the upper portion, while this mixture gas is produced by mixing oil components, smoke components, water vapor, seasonings, and the like with each other, which are produced when a cooking is performed by using the gas burners, or the electric burners, which are located at the lower portion.

At this time, however, although a portion of the above-described mixture gas made of the oil/smoke components, the water vapor, and the seasonings may be removed by the filter, the remaining exhausted mixture gas is conducted to the air-exhausting grille 8, so that oil components and dirt are adhered to an air-passage within the air-exhausting grille 8. To remove these oil components and dirt, this air-exhausting grille 8 is dismounted so as to be cleaned. Unless the mounting screws are removed by employing a tool, this air-exhausting grille 8 cannot be dismounted. Also, since these mounting screws are located at higher portions, the air-exhausting grille 8 cannot be dismounted unless a stand is employed. Thus, there are such problems that cumbersome works of preparing the tool are necessarily required, and also a care should be taken as to safety aspects such as injuries.

Moreover, in the microwave oven of the related art, a joint is made between the bottom plate and the lower portion of the body, and the head portion of the screw is projected, and also, the joint and the screw are present in the air-exhausting paths of the ventilation-purpose fan. As a result, noise is produced by wind-killing sound, ventilation capabilities are lowered by resistances, and oil components which are generated from the cooking instrument provided under the microwave oven are adhered to the joint and also the peripheral portions of the screws. Thus, dirt can be hardly removed, which deteriorates the cleaning characteristic. Also, since the joint and the screws are observed, in the case of the hanging type microwave oven, the body of this microwave oven under installation condition is located at eye-levels of users, so that this microwave oven owns a very poor design. Also, when a component is brought into a malfunction condition and this malfunction component is replaced by a normal component, if the body is not completely removed from the microwave oven, then this malfunction component cannot be replaced. Therefore, there is a problem that many steps of replacement operations are required.

SUMMARY OF THE INVENTION

The present invention has been made to solve the above-described conventional problems, and therefore, has an object to avoid a high frequency heating apparatus capable of simply mounting and/or dismounting an air-exhausting grille mounted on an upper portion of a main body without any tool to improve a detachability of the air-exhausting grille, capable of detaching the air-exhausting grille in safety and simple manners, and also capable of cleaning the air-exhausting grille in an easy manner, which may solve problems as to cumbersome tool-seeking works and dismounting of the air-exhausting grille by setting a stand. To solve the above-described problems, such a construction is employed. That is to say, screwing of an air-exhausting grille to a main body of a high frequency heating apparatus is avoided; a fixing claw portion is provided at an upper portion on the side of the air-exhausting grille; this fixing claw portion is inserted into a slit hole of the main body; and also, a fixing hooking portion provided a lower portion on the side of the air-exhausting grille is hooked to a hooking flange of the main body. Also, magnetic joint plates are mounted in the vicinity of both side surfaces of the air-exhausting grille; and magnetic fixing plates containing magnets are arranged at a place located opposite to the magnetic joint plates, so that the air-exhausting grille is fixed/mounted.

In accordance with the above-described high frequency heating apparatus of the present invention, a plurality of fixing claw portions having plurality of bent Z-shaped flanges are formed on an upper surface guide of said air-exhausting grille, and a plurality of fixing hooking portions having a plurality of notch portions are formed on a lower surface guide. Furthermore, a means for mounting the air-exhausting grille is arranged by utilizing these fixing claw portion and fixing hooking portion and by a slit hole and a hooking flange, which are provided on the main body. Also, another means for fixing the air-exhausting grille in a close contact manner is arranged by magnetic joint plates and magnetic fixing plates provided within both side surface guides. The use of fixing screws is avoided, the air-exhausting grille can be simply and easily mounted/dismounted without using any tool. As a result, the air-exhausting grille can be easily cleaned, and the clean high frequency heating apparatus can be obtained. Moreover, the present invention has also another object to provide a hanging type microwave oven constructed in such a manner that an integral type body having a U-shape and having no joint and no screw-fastening is constituted under the hanging type microwave oven; when a ventilating operation is performed by using a ventilation-purpose fan, a ventilating capability can be improved in low noise, and also, the hanging type microwave oven can be easily cleaned and can be made in a smart design, resulting in a good outer view thereof. Also, components under malfunction states can be readily replaced by normal components.

To solve the above-described problems, a high frequency heating apparatus, according to the present invention, is featured by that while a flat upper lid is arranged at an upper portion of a hanging type microwave oven, a body formed in a U-shape is mounted on both edge planes thereof, so that a replacement of a component can be easily carried out, and also, when the hanging type microwave oven is installed above a cooking instrument, a lower portion of this microwave oven has no joint portion.

In accordance with the present invention, approximately 90% of all components which constitute the microwave oven can be replaced by merely removing such an upper lid that the U-shaped body is mounted to be screwed to flanges of both edge planes of this upper lid. Thus, the components can be simply replaced and also can be easily repaired within short time. Also, since the body which is positioned above the cooking instrument is made in a U-shape and in an integral form, such a flat bottom plane having no joint at a lower portion and no projection such as a fixing screw is constituted, so that oil components attached to the U-shaped body, which are caused by oil and smoke components produced during cooking, can be cleaned in a simple manner.

In accordance with one aspect of the present invention, a high frequency heating apparatus is arranged by such a high frequency heating apparatus comprising: an air-exhausting grille having an air-exhausting port; a magnetic joint plate mounted/fixed on an inner side of the air-exhausting grille; and a magnetic fixing plate containing a magnet, which is located at a plane opposite to the magnetic joint plate. As a consequence, the air-exhausting grille can be simply mounted/dismounted without using any tool, as compared with the method for fastening the air-exhausting grille by way of screws and the like so as to fix this air-exhausting grille.

In accordance with yet another aspect of the present invention, a high frequency heating apparatus is arranged by such a high frequency heating apparatus comprising: an air-exhausting grille having an air-exhausting port, in which a fixing claw portion is provided on an upper surface guide of the air-exhausting grille, and a fixing hooking portion is provided on a lower surface guide; a magnetic joint plate mounted/fixed on inner sides of both side surface guides; and a magnetic fixing plate containing a magnet, which is located at a plane opposite to the magnetic joint plate. As a consequence, the magnetic joint plate can be mechanically made in close contact to the magnetic fixing plate due to the absorbing force of the magnets, so that the air-exhausting grille can be mounted without any play, and furthermore, the air-exhausting grille can be simply mounted/dismounted without using any tool, as compared with the method for fastening the air-exhausting grille by way of screws and the like so as to fix this air-exhausting grille.

In accordance with still yet another aspect of the present invention, a high frequency heating apparatus is featured by that an air-exhausting grille having a large number of segmented air-exhaust ports is arranged at an upper portion of a door and a control panel; a plurality of fixing claw portions having plurality of bent Z-shaped flanges are formed on an upper surface guide of the air-exhausting grille; a plurality of fixing hooking portions having a plurality of notch portions are formed on a lower surface guide; a plurality of slit holes having rectangular shapes, into which the fixing claw portions are inserted, are formed in upper planes located opposite to a rear side of the air-exhausting grille, which is constituted by mounting/fixing magnetic joint plates made of a sheet metal on inner sides of both side surface guides; a plurality of hooking flanges into which the fixing/hooking portions are inserted are formed on a lower surface portion; and magnetic fixing plates containing magnets are located at planes opposite to the magnetic joint plates of the both side surfaces.

Then, while plural sets of the fixing claw portions are formed on the upper surface guide of the air-exhausting grille and plural sets of the fixing hooking portions are formed on the lower surface guide thereof, the fixing claw portions having the bent Z-shapes are firstly inserted into the slits having the rectangular shapes formed in the main body and located opposite to the fixing claw portion along an upper inclined direction. Then, under such a condition that the fixing claw portions have been engaged with the slits, these fixing claw portions are rotated along a lower direction, while the slits are used as a fulcrum. As a result, the fixing hooking portion partially having a notched concave portion is engaged into the hooking flange formed in the lower portion of the main body, so that such a mechanical fixing means is constituted with respect to force along an upper/lower direction, a right left direction, and a forward/backward direction. Under this condition, since plays are produced due to a play of the slits, and a play dimension of the hook flange, the air-exhausting grille can be finally mounted without any play by the mechanical close-fitting means by employing the magnetic absorbing force between the magnetic joint plate and the magnetic fixing plate. As a consequence, the air-exhausting grille can be simply mounted/dismounted without using any tool, as compared with the method for fastening the air-exhausting grille by way of screws and the like so as to fix this air-exhausting grille.

In accordance with still yet another aspect of the present invention, a high frequency heating apparatus is arranged by either a hanging type or a wall-embedding type high frequency heating apparatus featured in that an electric burner, or a gas burner is installed at a lower portion; an air-intake port is provided via a filter on a lower surface; an air-exhausting passage is constituted around a heating chamber of a main body of the high frequency heating apparatus; an air-exhausting fan equipped with an air-exhausting fan motor is arranged at an upper portion of the main body; and an air-exhausting grille is mounted on a front surface of the upper portion of the main body. As a result, water vapor passes through the air-exhausting fan from the air-exhausting passage via the filter provided on the air-intake port, and then, is exhausted from the air-exhausting grille arranged at the upper front portion when the air-exhausting fan motor of the main body is driven for ventilation. This water vapor contains oil/smoke components and seasonings, which are produced from cooking by using the burner. Then, the air-exhausting grille is dirtied with oil components due to oil/smoke components and food remainders, so that the air-exhausting grille unit becomes disclosed due to dirt. The air-exhausting grille unit of the high frequency heating apparatus which is installed near eye levels of humans in either the hanging type or the wall-embedding type, can be simply mounted/dismounted without using any tool. The air-exhausting grille unit need not be mounted/dismounted, while the user steps on the stand, so that the safety mounting/dismounting operation can be carried out by the user. Therefore, the cleaning work of the air-exhausting grille can be improved, and the clean appliance can be provided.

In accordance with still yet another aspect of the present invention, a high frequency heating apparatus comprising: a heating chamber for heating food; a magnetron for generating high-frequency electromagnetic waves and for supplying the high-frequency electromagnetic waves into the heating chamber; and a waveguide on which an air-feeding fan for cooling the magnetron is mounted, and which guides the high-frequency electromagnetic waves generated from the magnetron into the heating chamber; an inverter power supply for supplying electric power to the magnetron so as to oscillate the high-frequency electromagnetic waves therefrom; and the air-feeding fan for cooling the inverter power supply, in which a front portion of the heating chamber is constructed of a door and a control panel for driving the above-described electronic components. Then, a body which covers an outer peripheral portion of the above-described high frequency heating apparatus is mounted in a U-shape, and an upper portion of this body is covered by a flat upper lid. Then, this body is fastened to edge planes of this flat upper lid by employing a screw. Ventilation-purpose air-intake ports are formed in both side surfaces of a bottom plane of this U-shaped body, and filters are mounted on these ventilation-purpose air-intake ports. In the hanging type high frequency heating apparatus arranged in such a manner that an air-exhausting path is formed on an outer peripheral wall of the heating chamber by the ventilation-purpose air-intake ports, and a ventilation-purpose fan is arranged at a center of the upper portion within the heating chamber, the body is made in the U-shape and is fastened to the edge planes of the upper lid provided at the upper portion by employing the screw. Thus, the high frequency heating apparatus having the smart design can be provided under hanging condition. Moreover, since there is neither the joint, nor the screw, wind-cutting sound and wind resistance in the air-exhausting path can be reduced, and also, the air ventilating efficiency can be improved in low noise when oil and smoke components, and water vapor, which are produced from a burner located under this high frequency heating apparatus, are sucked from the ventilation-purpose air-intake ports.

Still yet another aspect of the present invention can provide a hanging type high frequency heating apparatus having a high safety characteristic, since the U-shaped body is fabricated as an integral-processed U-shaped body without any joint up to an upper lid. Thus, under hanging condition of this high frequency heating apparatus, there is neither a joint, nor a screw in an eye-level portion, and this high frequency heating apparatus may have a smart design, but has no such a sharp edge, and no projection of a screw. Furthermore, dirt caused by oil and smoke components produced from the lower burner is not deposited on the above-described joint and screw, but may be cleaned by simply wiping this dirt. Thus, the cleaning characteristic of this high frequency heating apparatus can be improved.

Finally, another aspect of the present invention can provide such a hanging type heating apparatus which is arranged in such a manner that an upper edge surface of the U-shaped body is fastened to L-shaped bending portions of both edge planes of a flat upper lid from side surfaces thereof by using screws. When a repairing work is carried out, while the entire body of this hanging type microwave oven need not be disassembled, only the upper lid portion is merely disassembled, so that the troubled electronic components arranged on the upper portion of the heating chamber can be simply repaired, and replaced by normal electronic components. Accordingly, service characteristic of this hanging type microwave oven can be improved by reducing a total manipulation step.

Figure 1:
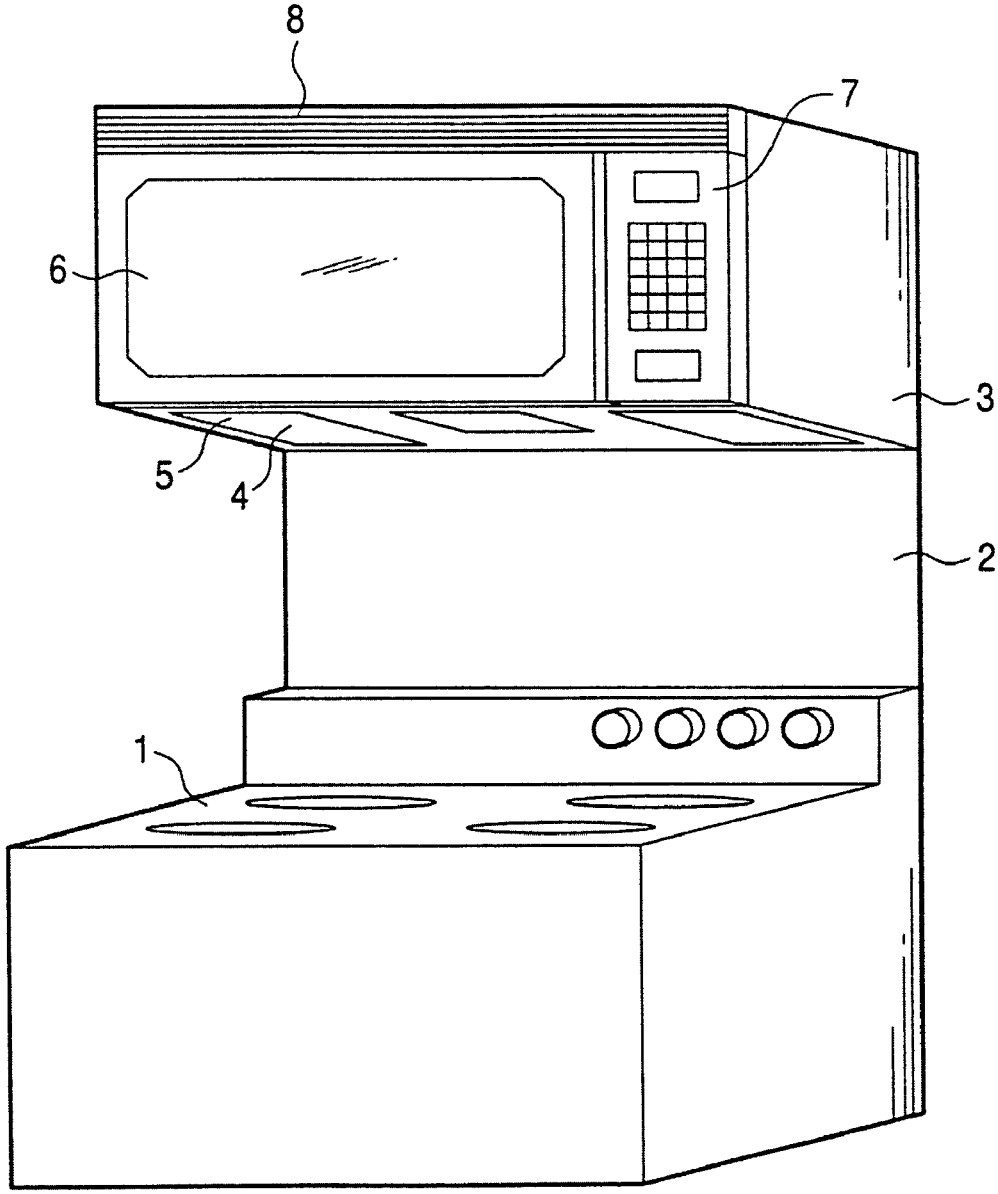
FIG.1 RELATED ART
FIG. 1 is a setting condition diagram of either a hanging type or a wall-embedding type high frequency heating apparatus according to an embodiment 1 of the present invention.

In the drawings, a reference numeral 1 shows a burner; 3 to a high frequency heating apparatus; 4 to a filter; 5 to an air-intake port; 6 to a door; 7 to a control panel; 8 to an air-exhausting grille; 9 to a heating chamber; 11 to an air-exhausting passage; 12 to an air-exhausting fan motor; 13 to an air-exhausting fan; 18 to an upper surface guide; 19 to a fixing claw portion; 20 to a lower surface guide; 21 to a fixing hooking portion; 22 to a side surface guide; 23 to a magnetic joint plate; 25 to a slit hole; 27 to a hooking flange; 28 to a magnetic fixing plate; 114 to a heating chamber; 125 to a ventilation-purpose fan; 126 to a body; 127 to an upper lid; 128 to a ventilation-purpose air-intake port; and 130 to an air exhaust path.

DETAILED DESCRIPTION OF THE PREFERRED EMBODIMENTS

Referring now to drawings, embodiments of the present invention will be described in detail.

Embodiment 1

Figure 2:
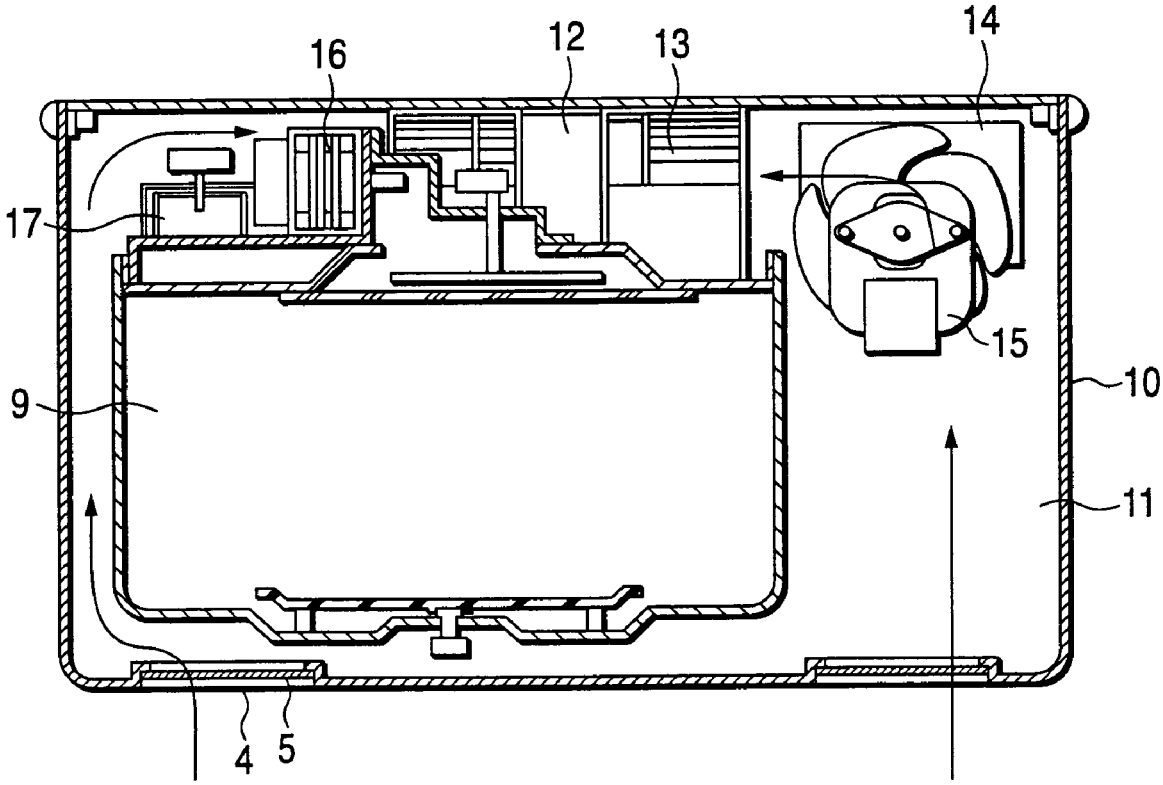
FIG. 2 is a front sectional view for showing the high frequency heating apparatus of the embodiment 1 of the present invention.
Figure 3:
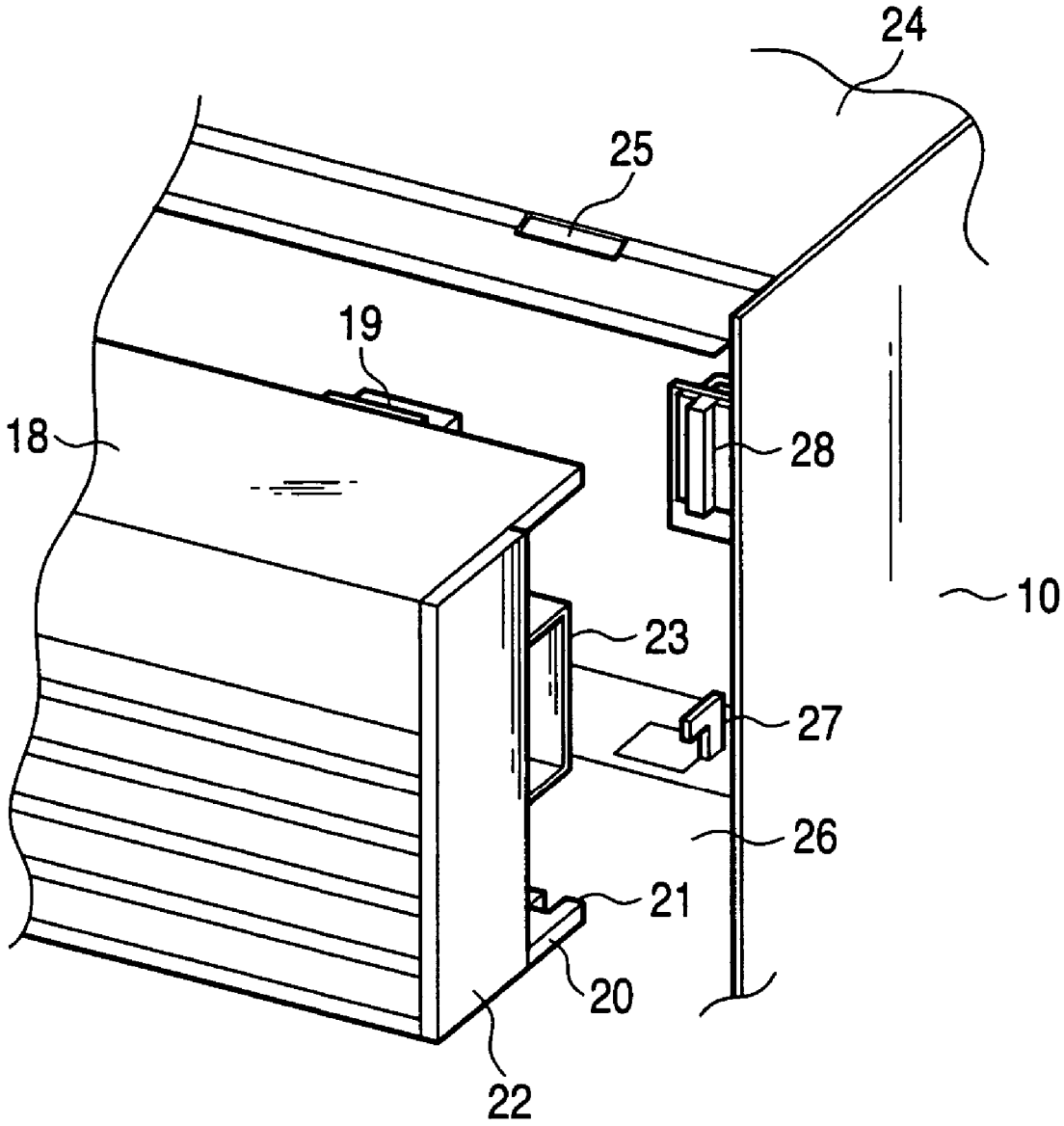
FIG. 3 is a diagram for representing a detailed construction of an air-exhausting grille unit employed in the high frequency heating apparatus of the embodiment 1 of the present invention.
Figure 4:
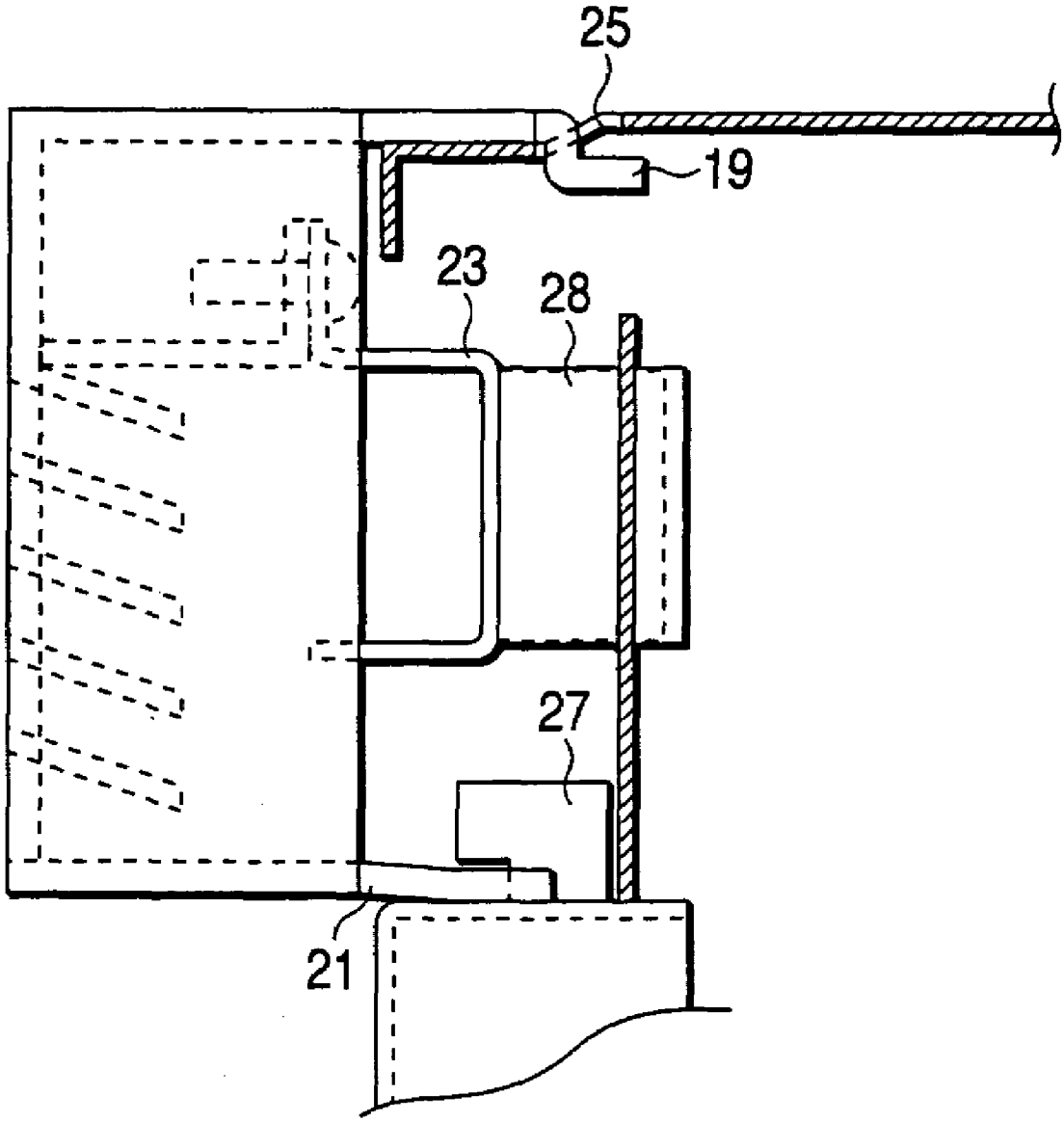
FIG. 4 is a sectional view for indicating a side surface portion of the air-exhausting grille employed in the embodiment 1 of the present invention.
Figure 5:
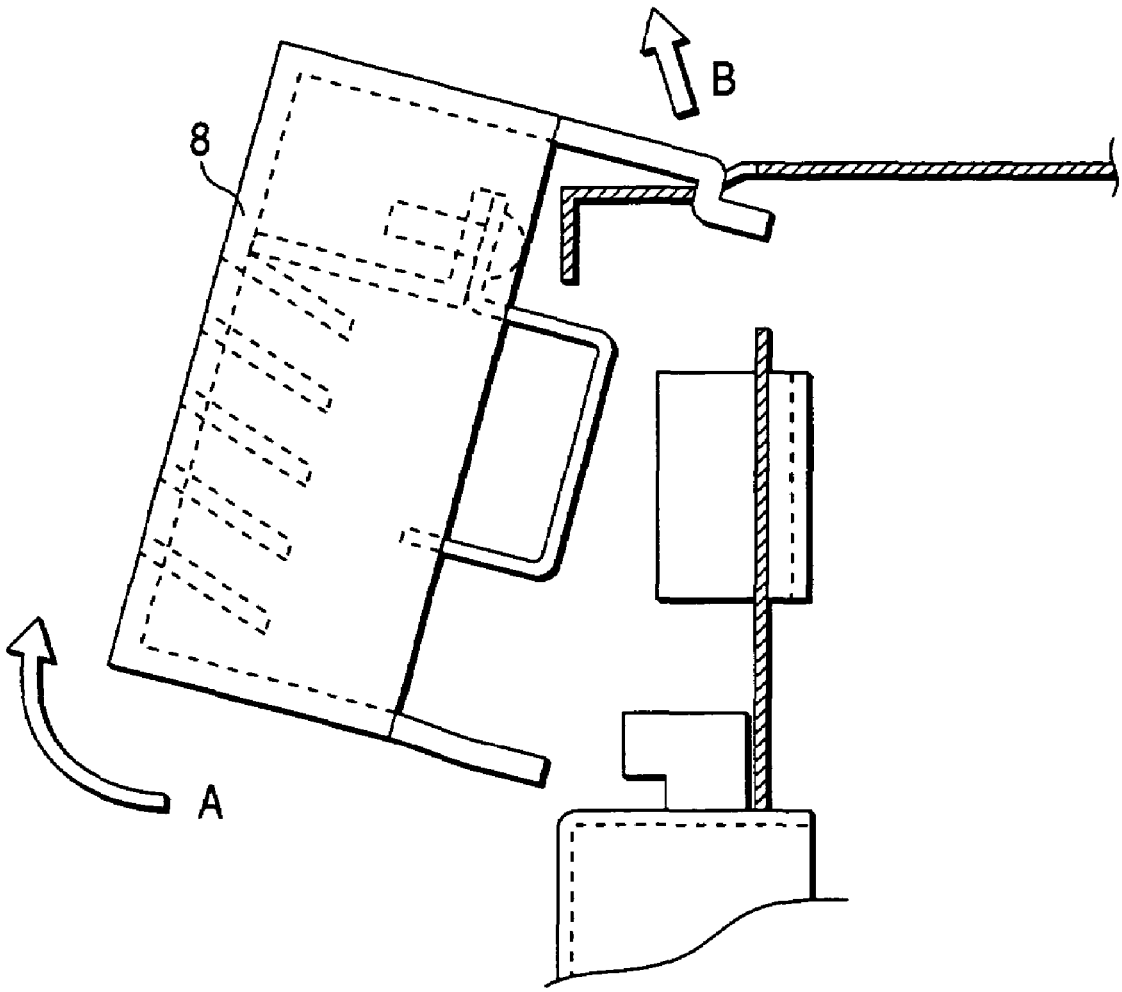
FIG. 5 is a sectional view for representing a side surface portion of a dismounting condition of the air-exhausting grille employed in the embodiment 1 of the present invention.
Figure 6:
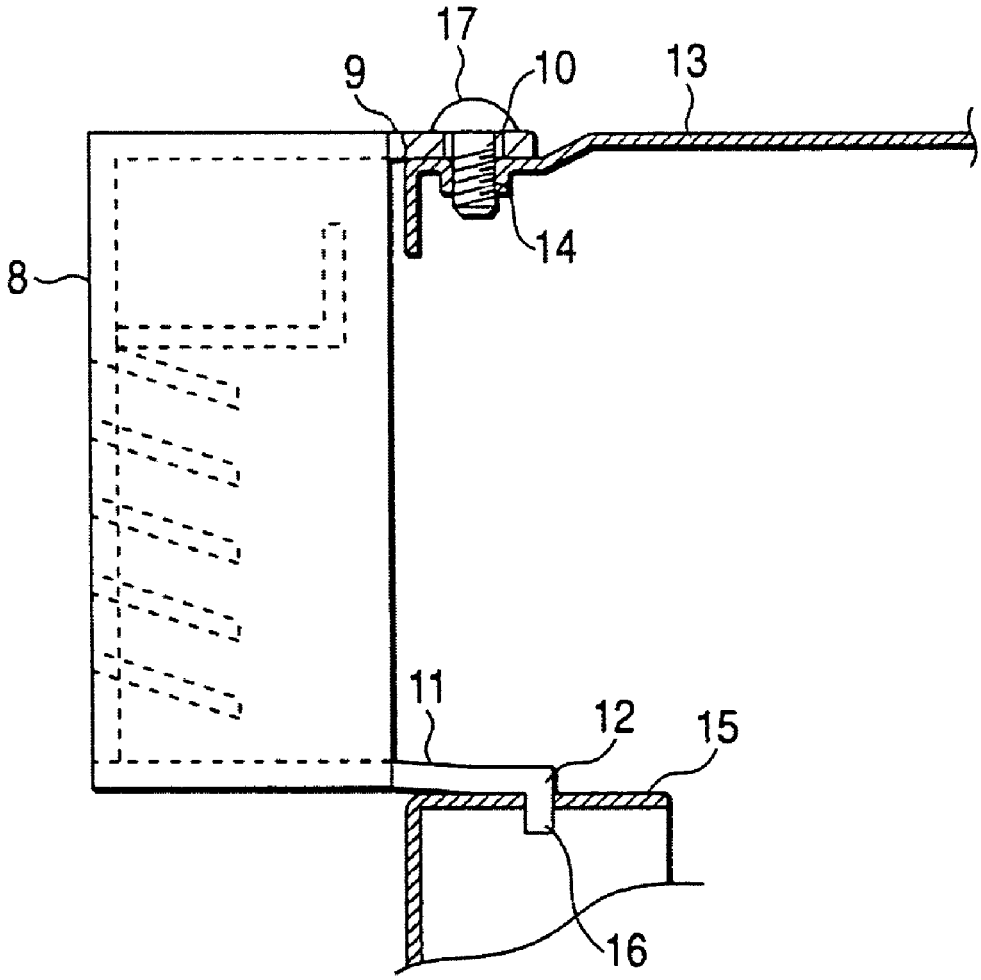
FIG.6 RELATED ART
FIG. 6 is a sectional view for showing the side surface portion of the fixing condition of the air-exhausting grille employed in the related art.

FIG. 1 is a diagram for representing a hanging type setting structure of a high frequency heating apparatus according to a first embodiment and a second embodiment of the present invention, and also shows the structure of the related art. FIG. 2 is a front sectional view for showing a main body of the high frequency heating apparatus according to the embodiment of the present invention. FIG. 3 is a diagram for partially indicating in detail an air-exhausting grille unit of this high frequency heating apparatus. FIG. 4 is a side sectional view for showing the grille unit of FIG. 3. FIG. 5 is a diagram for representing a mounting condition of the air-exhausting grille unit. FIG. 6 is a side sectional view for showing the conventional air-exhausting grille unit.

In FIG. 1, reference numeral 1 shows a cooking table on which several sets of either gas burners or electric burners are arranged, and a high frequency heating apparatus 3 is installed via a cooking space 2 at an upper portion of the cooking table 1. These instruments are installed by a hanging type in which these instruments are hung from a wood frame of an upper surface, or by a wall-embedding type in which these instruments are entered into a wood frame of an upper portion. Reference numeral 4 indicates filters which are arranged at right/left portions on a bottom plane of the high frequency heating apparatus 3. Reference numeral 6 shows a door, reference numeral 7 indicates a control panel, and reference numeral 8 denotes an air-exhausting grille arranged on the upper portion.

FIG. 2 is the sectional view for showing the construction of the high frequency heating apparatus 3. In this drawing, reference numeral 9 shows a heating chamber, reference numeral 10 indicates a body, reference numeral 11 represents air-exhausting passages which are constituted between the heating chamber 9 and the body 10 on the right/left sides. Reference number 12 shows an air-exhausting fan motor arranged at an upper portion of the heating chamber 9. This air-exhausting fan motor 13 is equipped with air-exhausting fans 13 on both sides. References numeral 14 shows a controller, reference numeral 15 indicates a cooling fan for the controller 14, reference numeral 16 denotes a high frequency generating apparatus, and reference numeral 17 indicates a cooling fan.

FIG. 3 is a partial diagram for showing such a structure that the air-exhausting grille 8 is mounted. FIG. 4 is a side view for showing a structure of FIG. 3. In the drawing, reference numeral 18 indicates an upper surface guide, reference numeral 19 shows a fixing claw portion having a bent Z-shape which is provided in the vicinity of both edge planes of the upper surface guide 18. Reference numeral 20 indicates a lower surface guide. Reference numeral 21 represents a fixing hooking portion having a notch portion with a concave shape, which is provided in the vicinity of both edge planes of the lower surface guide. Also, reference numeral 22 shows a side surface guide arranged on both edges. magnetic joint plates 23 having a ?-shape are fixed on both inner sides of this side surface guide 22 by using screws. A slit hole 25 having a rectangular shape is formed in a top plate 24 at a position opposite to the fixing claw portions on the side of the main body, and a fixing hooking flange 27 having an inversed L-shape is cut/raised from an upper plane flange of a door mounting plate 26 at a position opposite to the lower surface guide 20. Also, magnetic fixing plates 28 containing magnets are mounted on both side surfaces of the body 10 at a position opposite to the above-described magnetic jointing plates 23.

FIG. 5 represents such a condition that the air-exhausting grille 8 is mounted.

Next, operations and effects as to the high frequency heating apparatus with employment of the above-described arrangement will now be explained.

First, water vapor containing oil/smoke components and seasonings, which are produced when cooking is performed by using the burner 1 which is located at the lower portion and constitutes the cooking instrument, is penetrated through the filter 4 and is then conducted to the air-exhausting passages 11 formed between the heating chamber 9 and the body 10 by such a manner that the air-exhausting motor 12 is driven so as to rotate the air-exhausting fans 13 provided on both edges thereof. This air-exhausting motor 12 is assembled in the upper portion of the high frequency heating apparatus 3 which is arranged at the upper portion via the cooking space 2. The filter 4 is mounted on the air-intake port 5 of the lower portion. This conducted water vapor passes through the air-exhausting fan 13, and then is exhausted from the air-exhausting grille 8 arranged at the upper front portion into the room.

At this time, although the water vapor and like, which contain the oil/smoke components and the seasonings, are absorbed by the filter 4, all of dirt cannot be completely removed, so that the air-exhausting grille 8 is dirtied by the oil components for a long time period, is sticky with the oil components, and becomes disclosed. Thus, values of appliances would be lowered. Similarly, in such a case that desirable cooking is carried out by using the control panel 7 in the heating chamber 9 within the door 6 of the high frequency heating apparatus 3, electromagnetic waves are supplied from the high frequency generating apparatus 16 in response to a signal derived from the controller 14, and at this time, the controller 14 is cooled by the controller cooling fan 15, and also the high frequency generating apparatus 16 are cooled by the cooling fan 17. Also, in this case, when cooking is performed by using the lower burner 1, since the controller cooling fan 15 is driven, the oil/smoke components and the like are sucked from the lower portion. Also, the oil/smoke components and the like produced by performing cooking within the heating chamber 9 are also conducted via the air-exhausting port form the heating chamber 9 into the air-exhausting grille 8 in combination with air sucked from the cooling fan 17, so that dirt of the air-exhausting grille 8 is accelerated. In order to simply and quickly mount/dismount the air-exhausting grille 8 when the air-exhausting grille 8 is dirtied, as explained above, the fixing claw portions 19 having the bent Z-shape are formed on both sides of the upper surface guide 18 employed in the air-exhausting grille 8. Also, the fixing hooking portions 21 are formed on the both sides of the lower surface guide 20, while a tip portion of this fixing hooking portion 21 owns a concave-shaped notch portion. Then, a magnetic joint plate 23 is fixed on the inner plane of the side surface guide 22 by using the screws, and also, a slit hole 25 having a rectangular shape is formed in the front portion of the top plate 24 at the position opposite to the main body. Furthermore, a hooking flange 27 having an inversed L-shape is formed on the upper plane flange of the door mounting plate 26 provided in the lower portion, and also, the flange is provided in the vicinity of the upper edge plane of the body 10, so that a magnetic fixing plate 28 containing a magnet is constituted. Under mount condition of the air-exhausting grille 8, the fixing claw portion 19 is inserted into the slit hole 25, and the fixing hooking portion 21 is brought into such a condition that the notch portion of the concave portion is entered into the inversed L-shaped portion of the hooking flange 27. Under this condition, since a play is produced due to a play of the hole and a fluctuation of dimensions thereof, the magnetic joint plate 23 is attached to the magnetic fixing plate 28, so that the magnetic joint plate 23 can be fixed in close contact with the magnetic fixing plate 28 by utilizing magnetic force of the magnet, and thus, the air-exhausting grille 8 can be mounted with completely no play.

FIG. 5 shows such a condition that the air-exhausting grille 8 is dismounted. Since the lower surface guide 20 of the air-exhausting grille 8 is rotated along a direction indicated by an arrow "A", the absorption by the magnetic force exerted between the magnetic joint plate 23 and the magnetic fixing plate 28 is firstly separated by using the angular moment, and also, the fixing hooking portion 21 is dismounted from the inversed L-shaped portion of the hooking flange 27. As a result, the air-exhausting grille 8 can be completely dismounted by that while the fixing claw portion 19 having the bent Z-shape, which is entered into the slit hole 25, is slightly raised along the bent shape as shown by an arrow B, this fixing claw portion 19 is pulled out. When the air-exhausting grille 8 is mounted, a mounting manner of the air-exhausting grille 8 is performed in opposite sense with respect to the above-described dismounting manner thereof. That is, the fixing claw portion 19 of the air-exhausting grille 8 is firstly inserted into the slit hole 25, and is rotated along a direction opposite to the arrow "A", so that the notch concave portion of the fixing hooking portion 21 is inserted into the hooking flange 27, and the magnetic joint plate 23 is absorbed by the magnetic fixing plate 28. As a result, the air-exhausting grille 8 can be completely fixed.

As previously described, the air-exhausting grille 8 can be simply mounted and also can be easily mounted without using any tool. Also, this air-exhausting grille 8 can be mounted without using any screw. As a result, the user need not mount/dismount the air-exhausting grille 8 while the user steps on the stand, resulting in safety mounting of the air-exhausting grille 8. Also, since the air-exhausting grille 8 can be mounted/dismounted in an easy and quick manner, such a clean appliance can be provided with easy cleaning work, while dirt is continuously removed. Then, although the air-exhausting grille 8 can be mounted/dismounted by using no tool and also no screw, the mechanical mounting/dismounting effects of the air-exhausting grille 8 can be maintained by such a manner that since the fixing claw portion having the bent Z-shape and the fixing hooking portion are provided, the air-exhausting grille 8 cannot be dismounted until this air-exhausting grille 8 is rotated along the upper direction, and furthermore, the bent Z-portion is released from the slit hole in a stepped manner.

Even when the high frequency heating apparatus is installed at the higher position in either the hanging mode or the wall-embedding mode, such a detachability having a higher safety characteristic can be provided under such a condition that even if the air-exhausting grille 8 is tensioned along the upper/lower direction, the right/left direction, as well as the forward/backward direction, this air-exhausting grille 8 is not dismounted.

Embodiment 2

Figure 7:
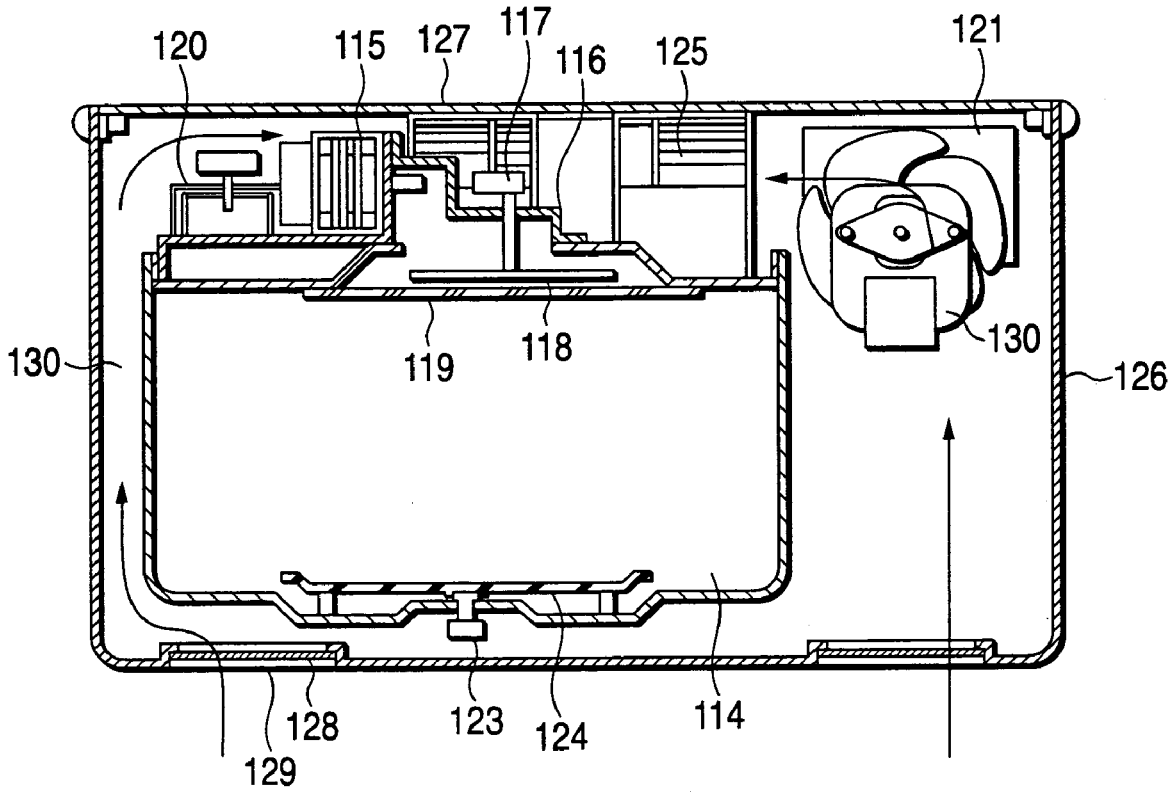
FIG. 7 is a front structural diagram of a heating chamber of a high frequency heating apparatus according to an embodiment 2 of the present invention.
Figure 8:
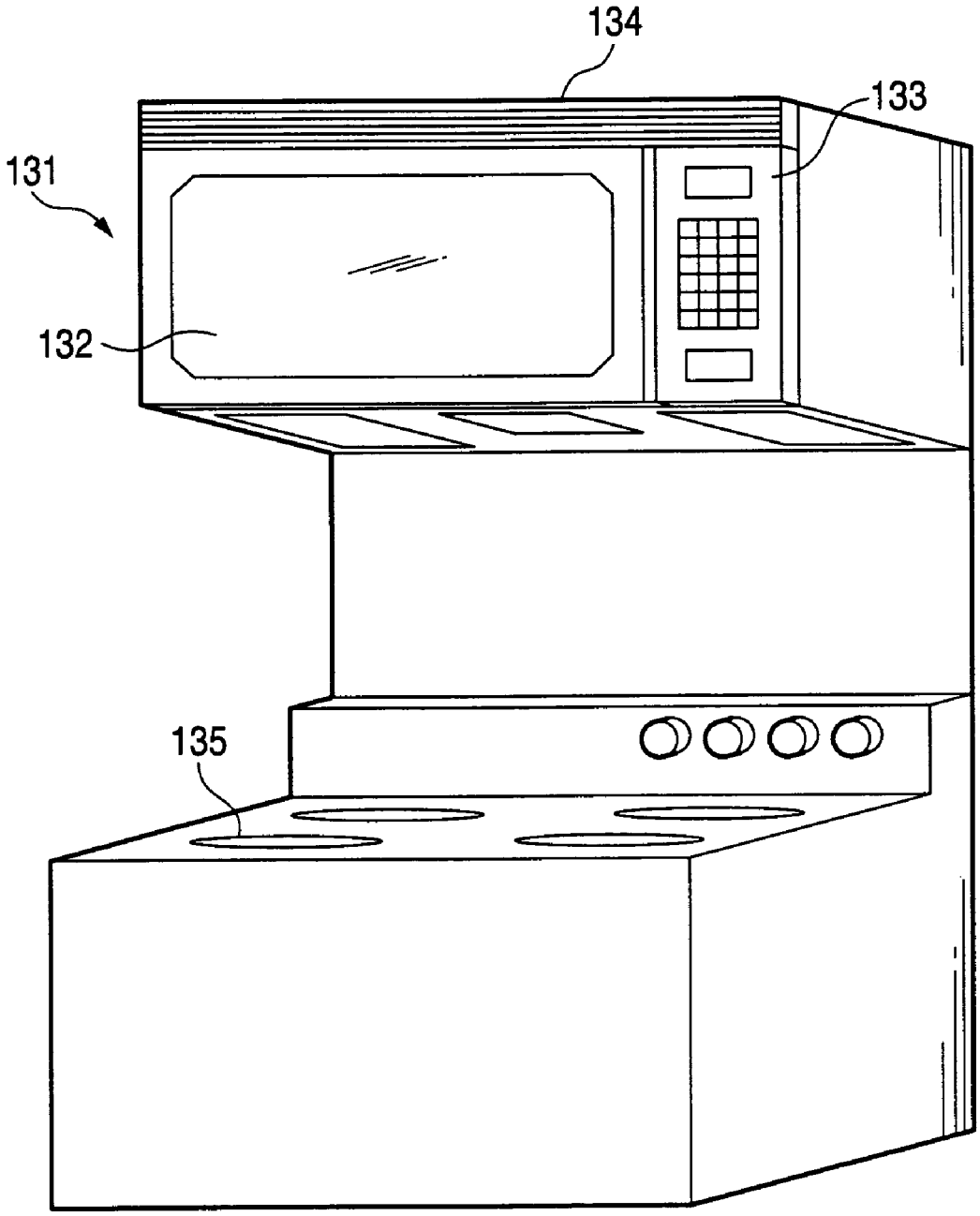
FIG. 8 is a schematic setting diagram of the high frequency heating apparatus according to the embodiment 2 of the present invention.
Figure 9:
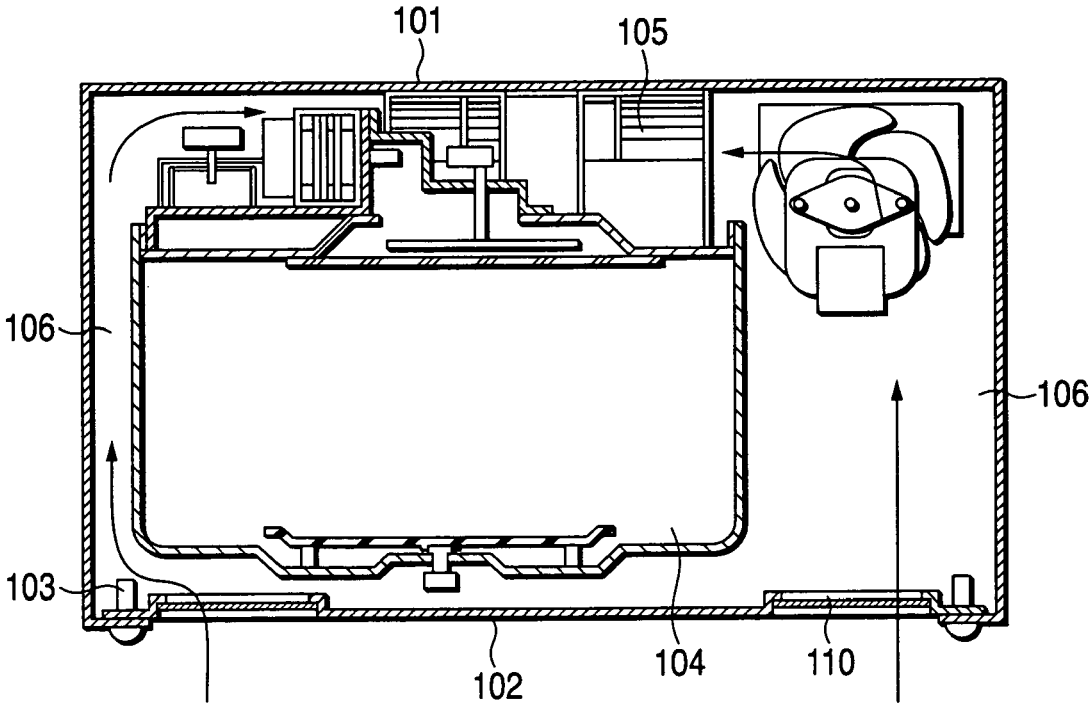
FIG. 9 is a front structural diagram of the heating chamber of the high frequency heating apparatus of the related art.

FIG. 7 shows a structural diagram of both a U-shaped body and an upper lid, which constitute a housing of a hanging type microwave oven according to an embodiment 2 of the present invention. FIG. 8 represents a setting condition diagram in the embodiment 2 of the present invention.

In FIG. 7, a heating chamber 114 is arranged in such a manner that a magnetron 115 for oscillating electromagnetic waves upwardly is connected to a waveguide 116 arranged on an upper surface of the heating chamber 114, a rotary antenna 118 is directed via a rotary motor 117 to an output port side of this waveguide 116, and a top plate 119 made of resin and mica is used to cover this heating chamber 114. A cooling-purpose scirocco fan motor 120 is provided behind the magnetron 115. Reference numeral 121 indicates an inverter power supply, and a cooling-purpose propeller fan motor 122 is mounted at a front portion of this inverter power supply 121. A table 124 is installed within the heating chamber 114 and is connected to a drive motor 123 on the outer side of a lower portion of the heating chamber 114. A ventilation-purpose fan 125 is provided behind an upper center portion of the heating chamber 114. In this ventilation-purpose fan 125, scirocco fans are arranged at right/left sides via a double-shaft type motor. A body 126 having an inverse U-shape is arranged around this heating chamber 114. This body 126 is screwed to be fixed on a body edge plane at an edge plane bending portion of a substantially flat upper lid 127 which is provided on an upper portion of this body 126. A ventilation-purpose air-intake port 128 is opened in both sides of a lower portion of the body 126 having the inverse U-shape, and then, filter 129 is mounted on this ventilation-purpose air-intake port 128. Reference numeral 130 represents right/left-sided exhausting paths (passages) which are formed between the heating chamber 114 and the body 126 having the inverse U-shape. The exhausting paths 130 are communicated up to the ventilation-purpose fan 125.

FIG. 8 represents such a condition that the hanging type microwave oven is installed, namely shows the microwave oven having this structure according to the embodiment 2, which is hung between cabinet shelves 131. This microwave oven is constituted by a door 132 at a front surface thereof, an operation unit 133 at a side portion thereof, and an air exhausting grille 134 positioned in front of the ventilation-purpose fan 125. A gas burner 135 is mounted at a lower portion.

Next, operations of the microwave oven will now be explained. When the door 132 is opened, an article to be heated is set on the table 124 provided inside the heating chamber 114, and then, a cooking mode is selected to start the microwave oven by the operation unit 133. As a result, high frequency electromagnetic waves which are generated from the magnetron 115 by a high frequency generating apparatus such as the inverter power supply 121 are penetrated through the waveguide 116 and then are conducted to the rotary antenna 118 which is rotated by the rotary motor 117, so that while the electromagnetic waves are stirred, the stirred electromagnetic waves may heat the article to be heated so as to cook this article. At this time, both the propeller fan motor 130 is driven so as to cool electronic components of the inverter power supply 121, and also the scirocco fan motor 120 is driven in order to cool the magnetron 115.

Next, in such a case that cooking is carried out by employing the gas burner 135, the ventilation-purpose fan 125 provided in the microwave oven installed on the cabinet shelves 131 is driven by operating the operation unit 133 so as to ventilate exhaust gas produced during cooking, and also water vapor, oil components, smoke components etc., which are produced during cooking. The exhaust gas which is collected via the filters 129 is penetrated through the air exhaust paths 130 formed on both sides of the heating chamber 114, and then, is conducted to the ventilation-purpose fan 125, while the filters 129 are mounted in the ventilation-purpose air-intake ports 28 which are formed in both lower sides of the inverse U-shape body 126. The exhaust gas conducted by the ventilation-purpose fan 125 is exhausted from the outlet port of this ventilation-purpose fan 125 via the exhaust grille 134 provided on the front plane of the microwave oven to an indoor area.

In this case, the ventilation-purpose fan 125 may exhaust the exhausted air along an outdoor direction, depending upon installation way thereof. Apparently, when the exhausted air is exhausted to the indoor area, oil components, smoke components, and impurities may be removed by the filters 129.

Also, the ventilation-purpose fan 125 may be controlled to prevent electronic components of the microwave oven main body from being electronically destroyed in the case that this ventilation-purpose fan 125 is forcibly driven by key-operating the operation unit 133, and/or in such a case that when temperatures of heat exhausted from the gas burner 135 is increased and thus the temperatures of the electronic components of this microwave oven located above this gas burner 135 are increased, the ventilation-purpose fan 125 is automatically controlled by a temperature detecting element (not shown) such as a thermistor so as to be driven.

As previously explained, while the body of the microwave oven is constructed in the U-shape, there is neither a joint, nor a screw connecting the bottom plate. Also, an abutting plane against the joint is the plane having no screw, and a space is not made. As a result, when the ventilation-purpose fan is driven, the exhaust gas which is conducted from the ventilation-purpose air-intake port formed in the lower portion may be exhausted under very low noise, since the wind-cutting sound and the air resistance within the air exhaust path are low, so that the exhausting efficiency can be increased.

Also, when the U-shaped body is set on the cabinet shelf, neither the joint, nor the screw is formed on the eye-level portion, and since the U-shaped body has the rounded portion having the U-shape without the sharp edge corner, this U-shaped body having a smart design can avoid a risk of injuries which are caused by the sharp edge corner and the projected screw, and thus can secure the safety requirement. Furthermore, dirt caused by oil and smoke components supplied from the lower gas burner can be simply wiped away, because of the U-shaped body, so that the clean characteristic and the cleaning effect of this U-shaped body can be improved.

Also, when the electronic components and the like are brought into malfunction conditions, the main body of the hanging type microwave oven is taken down from the cabinet shelf. In this malfunction case, while the entire body of this hanging type microwave oven need not be disassembled, only the upper lid portion is merely disassembled, so that the troubled electronic components arranged on the upper portion of the heating chamber can be repaired, and replaced by normal electronic components. Accordingly, service characteristic of this hanging type microwave oven can be improved by reducing a total manipulation step.

As previously described, the high frequency heating apparatus according to the present invention owns such a construction that the fixing claw portion is inserted into the slit hole at the upper portion of the air-exhausting grille, the fixing hooking portion is inserted into the hooking flange by the rotating operation at the lower portion of the air-exhausting grille, and furthermore, the magnetic joint plate is absorbed to the magnetic fixing plate.

As a consequence, the air-exhausting grille 8 can be simply mounted and also can be easily mounted without using any tool, the user need not mount/dismount the air-exhausting grille 8 while the user steps on the stand, resulting in safety mount of the air-exhausting grille 8. Also, since the air-exhausting grille 8 can be mounted/dismounted in an easy and quick manner, such a clean appliance can be provided with easy cleaning work.

Furthermore, as previously described, in the high frequency heating apparatus of the present invention, as such an appliance in which the outer housing is arranged by the U-shaped body and the flat upper lid and which is hung from the cabinet shelf, the joint can be eliminated from the lower portion of the appliance main body, fastening by the screw can be avoided, and dirt caused by oil and smoke components supplied from the lower gas burner can be simply wiped away due to the U-shaped integral body. As a result, the clean characteristic of this U-shaped body can be secured, and since the disturbing articles such as the joint and the screw are eliminated, the wind-cutting sound and the resistance of the air exhaust path can be reduced, so that the ventilation efficiency can be improved under low noise. Furthermore, when the high frequency heating apparatus is mounted on the cabinet self, such a smart design of the U-shaped body having no joint and no screw can be provided. Then, when the electronic components are repaired, while the U-shaped main body of the high frequency heating apparatus remains stationary, these troubled electronic components can be repaired and/or replaced by the normal electronic components by merely removing the upper lid. As a consequence, the repairing steps can be decreased and the service characteristic can be improved.

What is claimed is:

1. A high frequency heating apparatus comprising:

an air-exhausting grille having an air-exhausting port;

a magnetic joint plate mounted/fixed on an inner side of said air-exhausting grille; and a magnetic fixing plate containing a magnet, which is located at a plane facing to said magnetic joint plate.

2. A high frequency heating apparatus comprising:

an air-exhausting grille having an air-exhausting port, in which a fixing claw portion is provided on an upper surface guide of said air-exhausting grille, and a fixing hooking portion is provided on a lower surface guide;

a magnetic joint plate mounted/fixed on inner sides of both side surface guides; and a magnetic fixing plate containing a magnet, which is located at a plane facing to said magnetic joint plate.

3. A high frequency heating apparatus comprising:

an air-exhausting grille having an air-exhausting port; wherein:

a plurality of fixing claw portions having plurality of bent Z-shaped flanges are formed on an upper surface guide of said air-exhausting grille;

a plurality of fixing hooking portions having a plurality of notch portions are formed on a lower surface guide;

a plurality of slit holes having rectangular shapes, into which said fixing claw portions are inserted, are formed in upper planes located opposite to a rear side of the air-exhausting grille, which is constituted by mounting/fixing magnetic joint plates made of a sheet metal on inner sides of both side surface guides;

a plurality of hooking flanges into which said fixing/hooking portions are inserted are formed on a lower surface portion; and magnetic fixing plates containing magnets are located at planes facing to said magnetic joint plates of said both side surfaces.

4. A high frequency heating apparatus comprising:

an air-exhausting grille having an air-exhausting port;

a magnetic joint plate mounted/fixed on an inner side of said air-exhausting grille; and a magnetic fixing plate containing a magnet, which is located at a plane facing to said magnetic joint plate wherein:

an electric burner, or a gas burner is installed at a lower portion;

an air-intake port is provided via a filter on a lower surface;

an air-exhausting passage is constituted around a heating chamber of a main body of said high frequency heating apparatus;

an air-exhausting fan equipped with an air-exhausting fan motor is arranged at an upper portion of the main body; and an air-exhausting grille is mounted on a front surface of the upper portion of the main body.

5. A high frequency heating apparatus comprising:

an air-exhausting grille having an air-exhausting port, in which a fixing claw portion is provided on an upper surface guide of said air-exhausting grille, and a fixing hooking portion is provided on a lower surface guide;

a magnetic joint plate mounted/fixed on inner sides of both side surface guides; and a magnetic fixing plate containing a magnet, which is located at a plane facing to said magnetic joint plate wherein:

an electric burner, or a gas burner is installed at a lower portion;

an air-intake port is provided via a filter on a lower surface;

an air-exhausting passage is constituted around a heating chamber of a main body of said high frequency heating apparatus;

an air-exhausting fan equipped with an air-exhausting fan motor is arranged at an upper portion of the main body; and an air-exhausting grille is mounted on a front surface of the upper portion of the main body.

6. A high frequency heating apparatus comprising:

an air-exhausting grille having an air-exhausting port; wherein:

a plurality of fixing claw portions having plurality of bent Z-shaped flanges are formed on an upper surface guide of said air-exhausting grille;

a plurality of fixing hooking portions having a plurality of notch portions are formed on a lower surface guide;

a plurality of slit holes having rectangular shapes, into which said fixing claw portions are inserted, are formed in upper planes located opposite to a rear side of the air-exhausting grille, which is constituted by mounting/fixing magnetic joint plates made of a sheet metal on inner sides of both side surface guides;

a plurality of hooking flanges into which said fixing/hooking portions are inserted are formed on a lower surface portion; and magnetic fixing plates containing magnets are located at planes facing to said magnetic joint plates of said both side surfaces wherein:

an electric burner, or a gas burner is installed at a lower portion;

an air-intake port is provided via a filter on a lower surface;

an air-exhausting passage is constituted around a heating chamber of a main body of said high frequency heating apparatus;

an air-exhausting fan equipped with an air-exhausting fan motor is arranged at an upper portion of the main body; and an air-exhausting grille is mounted on a front surface of the upper portion of the main body.

* * * * *